United States Patent [19]

Shuttleworth et al.

[11] Patent Number: 4,923,788

[45] Date of Patent: May 8, 1990

[54] FILTER DYES FOR PHOTOGRAPHIC ELEMENTS

[75] Inventors: Leslie Shuttleworth, Webster; Paul B. Merkel; Glenn M. Brown, both of Rochester, all of N.Y.

[73] Assignee: Eastman Kodak Company, Rochester, N.Y.

[21] Appl. No.: 308,236

[22] Filed: Feb. 9, 1989

[51] Int. Cl.[5] ..... G03C 1/84; G03C 7/20

[52] U.S. Cl. ..... 430/507; 430/512; 430/522

[58] Field of Search ..... 430/507, 512, 522, 594, 430/595

[56] References Cited

U.S. PATENT DOCUMENTS 3,661,899 5/1972 Ford, Jr. et al. ..... 260/240

*Primary Examiner*—Richard L. Schilling

*Attorney, Agent, or Firm*—Paul L. Marshall

[57] ABSTRACT

Photographic elements comprising filter dyes of the formula:

R, R', L, L', L'', X, and n are as defined herein are disclosed.

18 Claims, No Drawings

FILTER DYES FOR PHOTOGRAPHIC ELEMENTS

FIELD OF THE INVENTION

This invention relates to photography, especially to dyes useful as filter dyes in photographic elements.

BACKGROUND OF THE INVENTION

Photographic materials may utilize filter dyes for a variety of purposes. Filter dyes may be used to adJust the speed of a radiation-sensitive layer, they may be used as so called absorber dyes to increase image sharpness, they may be used as antihalation dyes to reduce halation, and they may also be used to reduce the amount or intensity of radiation or to prevent radiation of a specific wavelength from reaching one or more of the radiation-sensitive layers in a photographic element. For each of these uses, the filter dye may be located in any of a number of layers of a photographic element, depending on the specific requirements of the element and the dye, and on the manner in which the element is to be exposed. The amounts of filter dyes used varies widely, but they are preferably present in amounts sufficient to alter in some way the photographic response of the element. Filter dyes may be located in a layer above a radiation-sensitive layer, in a radiation-sensitive layer, below a radiation sensitive layer, or in a layer on the opposite side of the support from a radiation-sensitive layer.

Photographic materials often contain layers sensitized to different regions of the spectrum, such as red, blue, green, ultraviolet, infrared, X ray, to name a few. A typical color photographic element contains a layer sensitized to each of the three primary regions of the visible spectrum, i.e., blue, green, and red. Silver halide used in these materials has an intrinsic sensitivity to blue light. Increased sensitivity to blue light, along with sensitivity to green light or red light, is imparted through the use of various sensitizing dyes adsorbed to the silver halide grains. Sensitized silver halide retains its intrinsic sensitivity to blue light.

If, prior to processing, blue light reaches a layer containing silver halide that has been sensitized to a region of the spectrum other than blue, the silver halide grains exposed to the blue light, by virtue of their intrinsic sensitivity to blue light, would be rendered developable. This would result in a false rendition of the image information being recorded by the photographic element. It is therefore a common practice to include in the photographic element a material that filters blue light. This blue absorbing material can be located anywhere in the element where it is desired to filter blue light. In a color photographic element that has layers sensitized to each of the primary colors, it is common to have the blue-sensitized layer closest to the exposure source and to interpose a blue-absorbing, or yellow, filter layer between the blue-sensitized layer and the green- and red-sensitized layers.

The material most commonly used as a blue-absorbing material in photographic elements is yellow colloidal silver, referred to in the art as Carey Lea silver. It absorbs blue light during exposure and is readily removed during processing, usually during the silver bleaching and fixing steps. Carey Lea silver, however, exhibits unwanted absorption in the green region of the spectrum. Also, silver can be an expensive component of a photographic element and can cause unwanted photographic fog.

A number of yellow dye alternatives for Carey Lea silver have been suggested. These include dyes disclosed in U.S. Pat. Nos. 2,538,008, 2,538,009, and 4,420,555, and U.K. Pat. Nos. 695,873 and 760,739. Many of these dyes, although they exhibit the requisite absorption of blue light, also are subject to stain problems.

Many filter dyes (yellow dyes as well as other colors) for use in photographic elements suffer from stain problems. Some dyes are not fully decolorized or removed during photographic processing, thus causing post processing stain. Other dyes wander into other layers of the element, adversely affecting image quality. Still other dyes react before exposure with other components of the photographic element, such as color couplers, thus causing incubative stain. Therefore, it would be desirable to provide a filter dye for use in photographic elements that does not suffer from incubative or post processing stain problems.

SUMMARY OF THE INVENTION

Photographic elements according to the invention contain filter dyes of the formula:

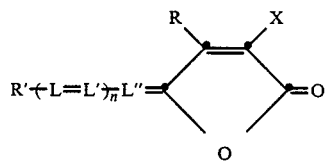

(I)

wherein R is substituted or unsubstituted alkyl or aryl, X is an electron withdrawing group, R' is substituted or unsubstituted aryl or a substituted or unsubstituted aromatic heterocyclic nucleus, and L, L', and L'' are each independently a substituted or unsubstituted methine group.

The dyes of formula (I) do not cause incubative stain in photographic elements and the elements are readily decolorized during photographic processing.

DETAILED DESCRIPTION OF THE INVENTION

According to formula (I), R is substituted or unsubstituted alkyl or aryl. Preferred alkyl groups include alkyl of from 1 to 20 carbon atoms, including straight chain alkyls such as methyl, ethyl, propyl, butyl, pentyl, decyl, dodecyl, and so on, branched alkyl groups such as isopropyl, isobutyl, t-butyl, and the like. These alkyl groups may be substituted with any of a number of known substituents, such as sulfo, sulfato, sulfonamide, amido, amino, carboxyl, halogen, alkoxy, hydroxy, phenyl, and the like. The substituents may be located essentially anywhere on the alkyl group. The possible substituents are not limited to those exemplified, and one skilled in the art could easily choose from a number of substituted alkyl groups that would provide useful compounds according to formula (I).

Preferred aryl groups for R include aryl of from 6 to 10 carbon atoms (e.g., phenyl, naphthyl), which may be substituted. Useful substituents for the aryl group include any of a number of known substituents for aryl groups, such as sulfo, sulfato, sulfonamido (e.g., butanesulfonamido), amido, amino, carboxyl, halogen, alkoxy, hydroxy, acyl, phenyl, alkyl, and the like. Additionally, the aryl group may have substituents that form fused ring systems with it, such as naphthyl. The substituents can be located essentially anywhere on the ring. The possible substituents are not limited to those exemplified, and one skilled in the art could easily choose from a number of substituted aryl groups that would provide useful compounds according to formula (I).

X represents an electron withdrawing group. Electron withdrawing groups in organic compounds are well-known in the art, such as described in J. Marsh, *Advanced Organic Chemistry,* 3rd Ed., p. 238, the disclosure of which is incorporated herein by reference in its entirety. Useful electron withdrawing groups include, for example, cyano, substituted or unsubstituted carboxylate (preferably of from 2 to 7 carbon atoms, e.g., $CO_2R^3$ where $R^3$ is substituted or unsubstituted alkyl or aralkyl), and —CO—R″ where R″ is primary or secondary amino, and aryl (either unsubstituted or substituted with an electron withdrawing group, e.g., phenyl, p-nitrophenyl, p-cyanophenyl, 3,4-dichlorophenyl). The possible substituents for the various X and R″ groups will be known to those skilled in the art and include those described herein for R and R′.

R′ represents aryl, preferably of from 6 to 10 carbon atoms, which may be substituted, as described above with respect to R, or a substituted or unsubstituted aromatic heterocyclic ring, preferably a 5- or 6 -membered ring, which may be fused with another ring system. When R′ is a 6-membered heterocyclic ring, the ring preferably contains at least one nitrogen atom. Examples of useful aromatic heterocyclic rings include furan, thiophene, pyridine, pyrrole, and imidazole. These rings may be substituted as described with respect to the aryl groups. In one preferred embodiment, R′ is or is substituted with an electron donor group. Electron donor groups for organic compounds are well-known in the art, as described in the above-referenced Marsh, *Advanced Organic Chemistry,* 3rd. Ed. and include, for example alkoxy, aryloxy, —NHCOR where R is alkyl or aryl, —OCOR where R is alkyl or aryl, and —SR where R is alkyl or aryl.

In a preferred embodiment, R, R′, or X may be substituted with at least one solubilizing group. This enables the dyes to be solubilized and removed and/or decolorized during processing so as to minimize dye stain caused by residual dye. Such solubilizing groups are known in the art and include, for example sulfonate (e.g . $SO_3Na$), sulfato, carboxy salts (e.g., $CO_2Na$), and the like. In an especially preferred embodiment, the solubilizing group comprises an ionizable proton (e.g., $CO_2H$, $NHSO_2R$ where R is substituted alkyl of from 1 to 12 carbon atoms or substituted or unsubstituted aryl of from 6 to 12 carbon atoms. Such ionizable protons tend to cause the dyes of formula (I) to be insoluble at acid to neutral coating pH's and soluble at neutral to basic processing pH's. Dyes according to formula (I) comprising such ionizable protons are well-adapted to use in photographic elements in the form of solid particle dispersions, described below.

In a preferred embodiment of the invention, the dye of formula (I) is a yellow filter dye where n is 0 and R′ is selected from the group consisting of furan, methylfuran, pyrrole, aryl, and thiophene.

Examples of useful dyes according to formula (I) are shown below.

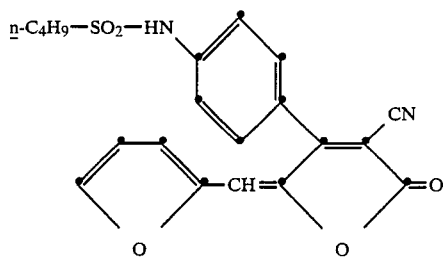

(1)

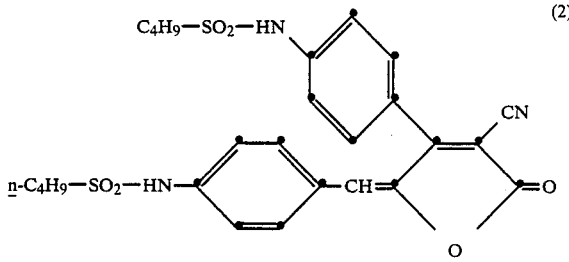

(2)

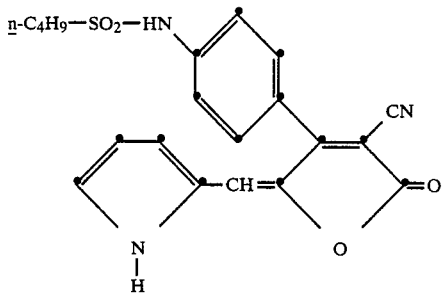

(3)

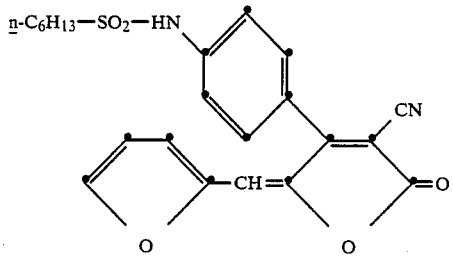

(4)

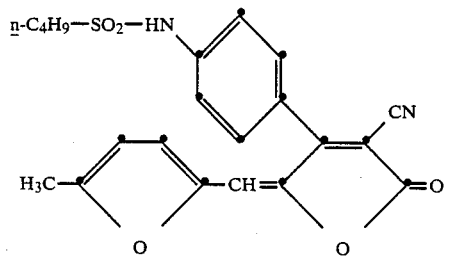

(5)

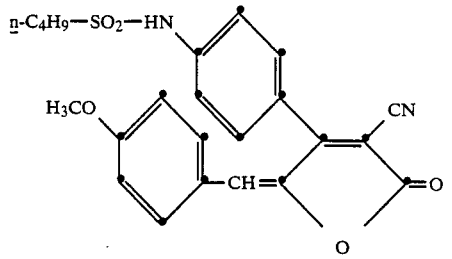

(6)

-continued
(7)
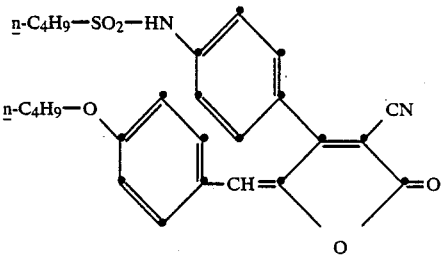
(8)
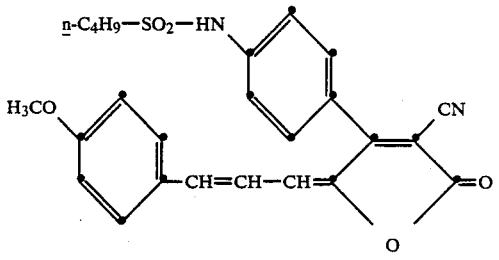
(9)
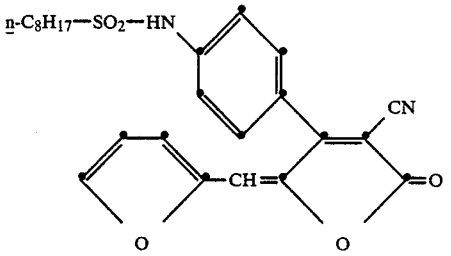
(10)
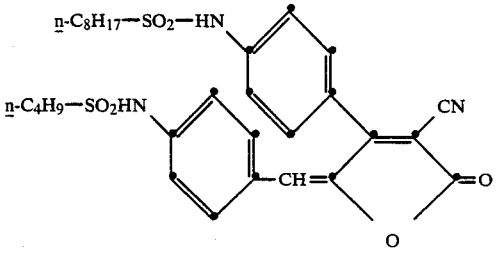
(11)
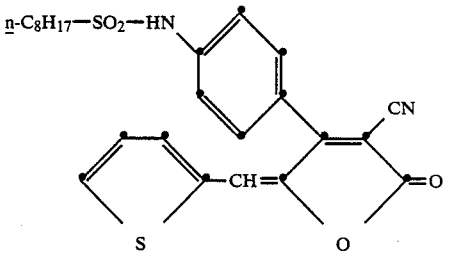
(12)
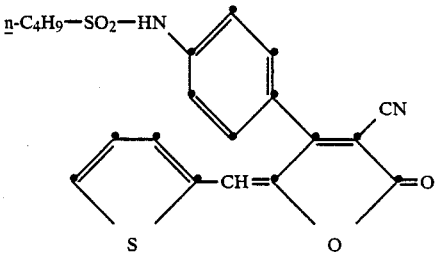
-continued
(13)
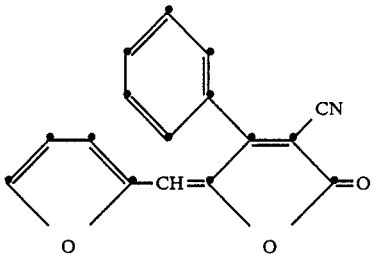
(14)
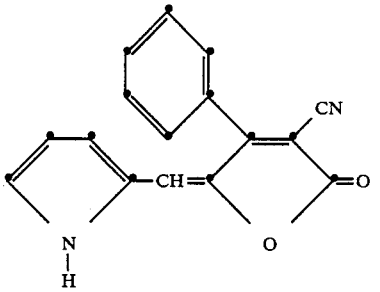
(15)
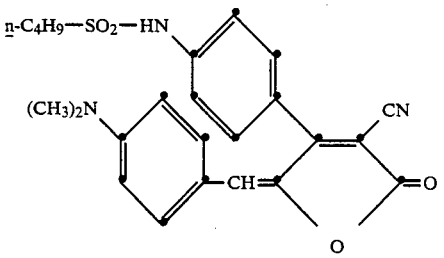
(16)
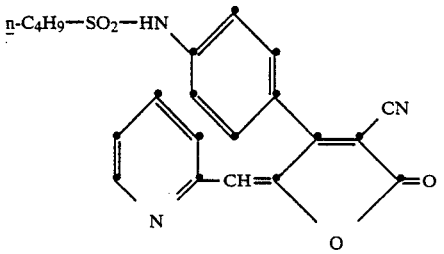
(17)
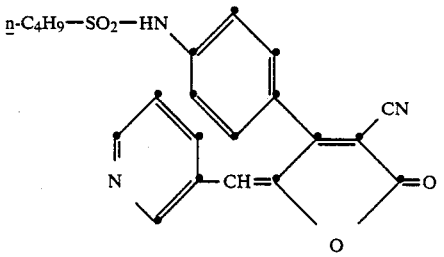
(18)
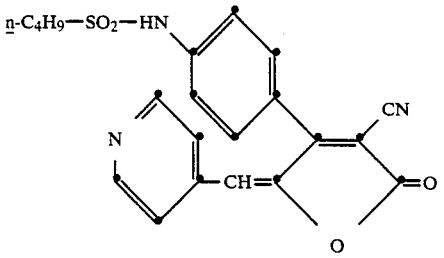

-continued
(19)
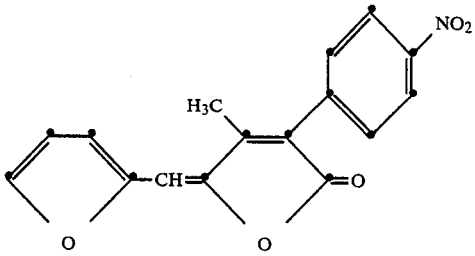
(20)
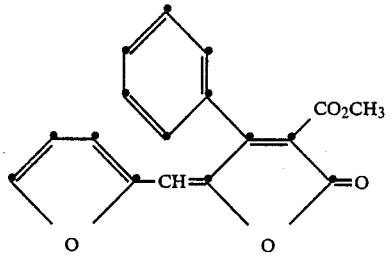
(21)
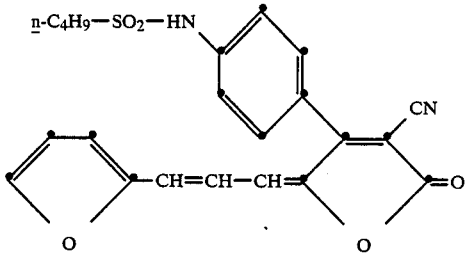
(22)
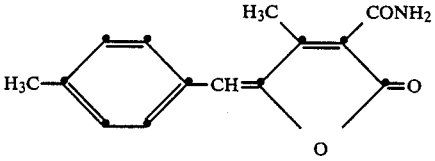
(23)
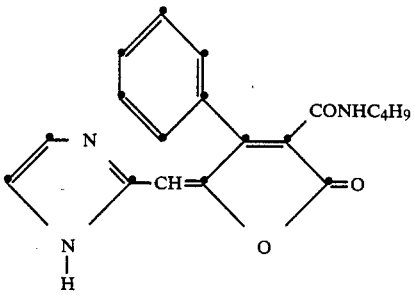
(24)
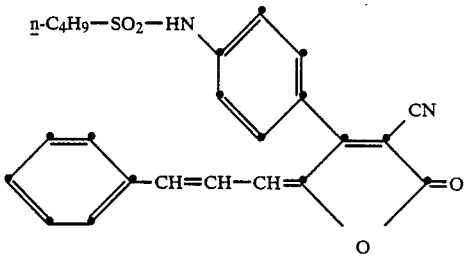
-continued
(25)
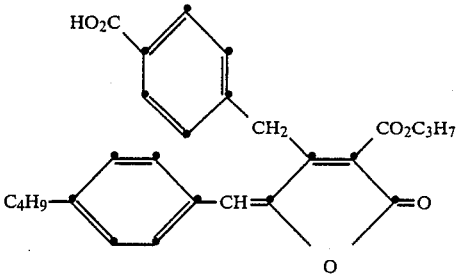
(26)
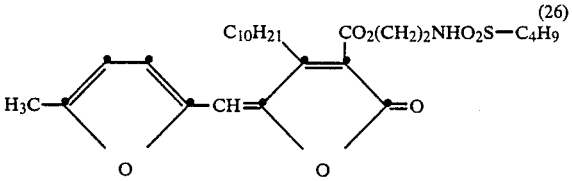
(27)
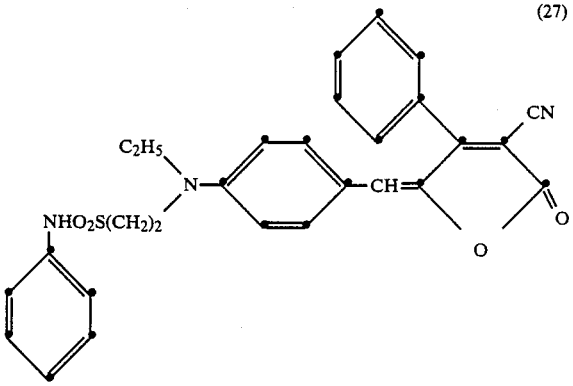
(28)
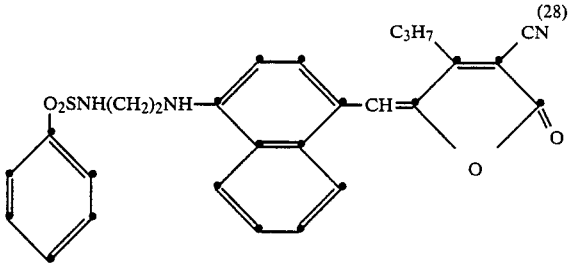
(29)
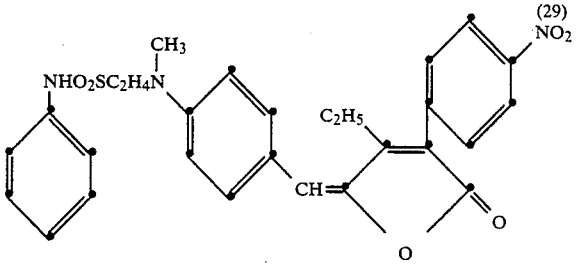
(30)
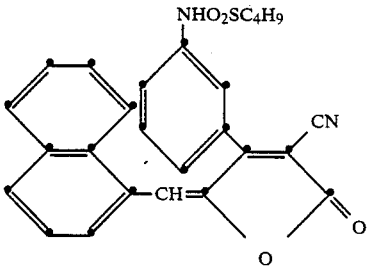

-continued (31)

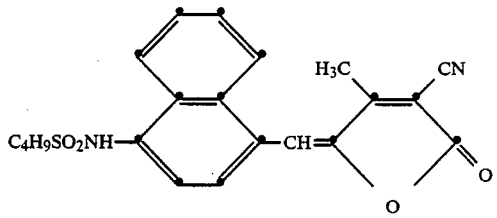

The dyes of formula (I) can be prepared by well known chemical synthetic techniques, such as described in U.S. Pat. No. 3,661,899. The synthesis of dyes according to formula (I) is described below in further detail in the Examples.

The dyes of formula (I) are useful as filter dyes for any of the purposes and in any of the locations described above where it would be known to one skilled in the art to use filter dyes. Such elements generally comprise a support having thereon one or more radiation-sensitive layers, usually silver halide layers along with a number of other layers known to those skilled in the art, as described below.

The support of the element of the invention can be any of a number of well known supports for photographic elements. These include polymeric films such as cellulose esters (e.g., cellulose triacetate and diacetate) and polyesters of dibasic aromatic carboxylic acids with divalent alcohols (e.g., poly(ethylene terephthalate)), paper, and polymer-coated paper. Such supports are described in further detail in *Research Disclosure,* December, 1978, Item 17643 [hereinafter referred to as Research Disclosure], Section XVII.

The radiation-sensitive layer of the element of the invention can contain any of the known radiation-sensitive materials, such as silver halide, diazo image-forming systems, light-sensitive tellurium-containing compounds, light-sensitive cobalt-containing compounds, and others described in, for example, J. Kosar, Light Sensitive Systems: Chemistry and Application of Nonsilver Halide Photographic Processes, J. Wiley & Sons, N.Y. (1965). Radiation-sensitive materials exhibiting sensitivity to blue light and especially those sensitive to blue light and at least some other wavelength of radiation are preferred, as the dyes according to the invention can be advantageously used to absorb some or all of the blue light.

Silver halide is especially preferred as a radiation-sensitive material. Silver halide emulsions can contain, for example, silver bromide, silver chloride, silver iodide, silver chlorobromide, silver chloroiodide, silver bromoiodide, or mixtures thereof. The emulsions can include coarse, medium, or fine silver halide grains bounded, for example, by 100, 111, or 110 crystal planes. Silver halide emulsions and their preparation are further described in *Research Disclosure,* Section I. Also useful are tabular grain silver halide emulsions, as described in *Research Disclosure,* January, 1983, Item 22534 and U.S. Pat. No. 4,425,426.

The radiation-sensitive materials described above can be sensitized to a particular wavelength range of radiation, such as the red, blue, or green portions of the visible spectrum, or to other wavelength ranges, such as ultraviolet, infrared, X-ray, and the like. Sensitization of silver halide can be accomplished with chemical sensitizers such as gold compounds, iridium compounds, or other group VIII metal compounds, or with spectral sensitizing dyes such as cyanine dyes, merocyanine dyes, styryls, or other known spectral sensitizers. Additional information on sensitization of silver halide is described in *Research Disclosure,* Sections I–IV.

The radiation sensitive material and the dye of formula (I) are preferably dispersed in film forming polymeric vehicles and/or binders, as is well-known in the art. These include both naturally occurring and synthetic binders, such as gelatin and gelatin derivatives, polyvinyl alcohols, acrylamide polymers, polyvinylacetals, polyacrylates, and the like. Additional disclosure relating to useful vehicles and/or binders can be found in *Research Disclosure,* Section IX. In certain instances, especially where the dye is mobile (e.g., a dye with one or more $SO_3^{\ominus}$ substituents), it may be advantageous use the dye in combination with a mordant, such as polyvinylimidazole or polyvinylpyridine, to aid in immobilizing the dye. The technology of mordanting dyes is well-known in the art, and is described in further detail in Jones et al U.S. Pat. No. 3,282,699 and Heseltine et al U.S. Pat. Nos. 3,455,693 and 3,438,779.

In many instances, it is preferable to use a dispersing aid to help disperse the dye in the binder. Such dispersing aids are well-known in the art and include tricresyl phosphates, n-$C_{11}H_{23}CON(C_2H_5)_2$, or dibutyl phthalate. Also, in a preferred embodiment, the dye is dispersed in the binder in the form of a solid particle dispersion, where small solid particles of the dye (having a mean diameter on the order of 10 μm or less and preferably 1 μm or less) are dispersed throughout the binder. Such dispersions are formed either by milling the dye in solid form until the desired particle size range is reached or by precipitating the dye directly in the form of a solid particle dispersion. Alternatively, the dye can be loaded into a latex polymer, either during or after polymerization, and the latex can be dispersed in a binder. Additional disclosure on loaded latexes can be found in Milliken U.S. Pat. 3,418,127.

The filter dye of formula (I) may be located in any of a number of layers of a photographic element, depending on the specific requirements of the element and the dye, and on the manner in which the element is to be exposed. The dye may be located in a layer above the radiation-sensitive layer, in the radiation-sensitive layer, below the radiation-sensitive layer, or in a layer on the opposite side of the support from the radiation-sensitive layer. The dye of formula (I) is present in a layer of the photographic element in an amount to be effective as a photographic filter dye, as would be known to one skilled in the art. The dye of formula (I) is preferably present in an amount of from 1 to 2000 mg/m$^2$ and more preferably in an amount of from 50 to 500 mg/m$^2$. The dye preferably provides an optical density of 0.1 to 3.0 density units at its λ-max.

In a preferred embodiment, the dye of formula (I) is a yellow filter dye. A preferred class of yellow filter dyes are dyes according to formula (I) where n is 0, X is cyano and R′ is furan, thiophene, or pyrrole (preferably furan). The hue of the dye can be shifted by increasing or decreasing the charge separation between X and R′ and/or by varying n. Increasing the charge separation, either by making R′ a stronger electron donor or by making X a stronger electron acceptor or both will tend to shift the absorption of the dye to longer wavelengths. Decreasing the charge separation, either by making R′ a weaker electron donor or by making X a weaker electron acceptor or both will tend to shift the absorption of the dye to shorter wavelengths. Increasing n will tend to shift the absorption to longer wavelengths and decreasing n will tend to shift the absorption to shorter wavelengths. Starting with the above-defined preferred group of yellow dyes, one skilled in the art would be able to vary X, R', and n to provide other yellow filter dyes within the scope of formula (I).

A yellow filter dye according to formula (I) can be used in any photographic element where it is desirable to absorb light in the blue region of the spectrum. The dye could be used, for example, in a separate, non-light-sensitive filter layer or as an intergrain absorber in a radiation-sensitive layer. The dye is especially advantageously utilized in photographic elements having at least one silver halide layer that is sensitive to some wavelength of radiation other than blue light in addition to its intrinsic sensitivity to blue light. In such an instance, the dye can be used to reduce or prevent blue light from reaching this silver halide, thus assuring that the response of the silver halide will be to the radiation to which it is sensitized rather than from its intrinsic sensitivity to blue light.

Although a yellow dye according to formula (I) can be utilized in any photographic element where it is desired to absorb blue light, the dye is especially advantageously utilized in photographic elements having at least one silver halide layer that is sensitive to some wavelength of radiation other than blue light, e.g., a color photographic element. Color photographic elements generally comprise a blue-sensitive silver halide layer having a yellow color-forming coupler associated therewith, a green-sensitive layer having a magenta color-forming coupler associated therewith, and a red-sensitive silver halide layer having a cyan color-forming coupler associated therewith. In such an element, the yellow filter dye according to formula (I) would preferably be located below the blue-sensitive layer and above the green- and red-sensitive layers. Color photographic elements and color-forming couplers are well-known in the art and are further described in *Research Disclosure,* Section VII.

The element of the invention can also include any of a number of other well-known additives and layers, as described in *Research Disclosure.* These include, for example, optical brighteners, antifoggants, image stabilizers, light-absorbing materials such as filter layers or intergrain absorbers, light-scattering materials, gelatin hardeners, coating aids and various surfactants, overcoat layers, interlayers and barrier layers, antistatic layers, plasticizers and lubricants, matting agents, development inhibitor-releasing couplers, bleach accelerator-releasing couplers, and other additives and layers known in the art.

In a preferred embodiment of the invention, the dye of formula (I) is in a layer that is positioned between two light-sensitive silver halide layers, at least one of which is sensitive to at least one region of the spectrum other than blue. Such an element can be, for example, a color photographic element having a blue-sensitive layer, a green-sensitive layer, and a red-sensitive layer. In such an element, the layer containing the dye of formula (I), is preferably a yellow filter layer positioned between the blue-sensitive layer and all of the green- and red-sensitive layers, although it is possible for certain applications to have some of the red and/or green layers closer to the blue-sensitive layer than the yellow filter layer. One such alternative arrangement is described in U.S. Pat. No. 4,129,446, where a yellow filter layer is positioned between pairs of green- and red-sensitive emulsion layers so that at least some blue light reaches the faster green- and red-sensitive layers before striking the yellow filter layer. Other alternative arrangements are described in U.S. Pat. Nos. 3,658,536, 3,990,898, 4,157,917, and 4,165,236.

The photographic elements of the invention, when exposed, can be processed to yield an image. During processing, the dye of formula (I) will generally be decolorized and/or removed. Following processing, the dye of the invention should contribute less than 0.05 density unit, and preferably less than 0.02 density unit to the transmission D-max in the visible region in the minimum density areas of the exposed and processed element.

Processing can be by any type of known photographic processing, as described in *Research Disclosure,* Sections XIX–XXIV, although it preferably includes a high pH (i.e., 9 or above) step utilizing an aqueous sulfite solution in order to maximize decolorization and removal of the dye. A negative image can be developed by color development with a chromogenic developing agent followed by bleaching and fixing. A positive image can be developed by first developing with a non-chromogenic developer, then uniformly fogging the element, and then developing with a chromogenic developer. If the material does not contain a color-forming coupler compound, dye images can be produced by incorporating a coupler in the developer solutions.

Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium of potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The invention is further illustrated by the following Examples:

Synthesis Example 1 - Preparation of Dye 1

Furfural (0.48 g) was dissolved in ethanol (15 ml), and 4-(4-'butane sulfonamido)-3-cyano-2-furanone (1.6 g) was added together with 0.5 g sodium acetate. The mixture was heated at about 40–45° C. for 2 hours and then cooled to room temperature. The solid material was filtered off and washed with a 50/50 mixture of ethanol and water to yield 1.6 g of Dye 1. $\lambda$-max=414 nm (methanol), $\epsilon$max=$3.4\times10^4$.

Synthesis 2 - Preparation of Dye 2

4-Butane sulfonamidobenzaldehyde (0.3 g) was dissolved in acetic acid (10 ml) and 4-(4-'butane sulfonamido)-3-cyano-2-furanone (0.4 g) was added. The mixture was heated with a steam bath for 60 minutes after addition of sodium acetate (0.25 g) and allowed to cool. The mixture was then poured into water, stirred for 60 minutes, and the yellow-brown solid that formed was filtered off, washed with water, dried, and recrystallized from methanol to yield Dye 2. $\lambda$-max=406 (methanol), $\epsilon$-max=$3.59\times10^4$.

EXAMPLE 1

A solid particle dispersion of Dye 1 was prepared according to the following technique. 1.0 g of the dye was placed in a 60 ml screw-capped bottle along with 21.7 ml water, 2.65 g Triton X-200® surfactant (Rohm & Haas), and 40 ml of 2 mm diameter zirconium oxide beads. The bottle was capped and the contents milled for four days. The container was removed and the contents added to a 12.5% aqueous gelatin (8.0 g) solution. This mixture was placed on a roller mill for 10 minutes to reduce foaming and the resulting mixture was filtered to remove the zirconium oxide beads.

The above-described solid particle dispersion was coated as a yellow filter dye in a color photographic element having the following format (coverages in parentheses):

| | |
|---|---|
| Bis-vinylsulfonyl methyl ether | (1.55% of total gel) |
| Gelatin | (980 mg/m$^2$) |
| Gelatin and ultraviolet filter | (1786 mg/m$^2$) |
| AgBrI (6.4% I) (1.8μ and 0.65μ) | (1561 mg/m$^2$) |
| Sensitizing Dye SD-1 | (458 mg/mole Ag) |
| Yellow Dye-Forming Coupler C-1 | (1819 mg/m$^2$) |
| Gelatin | (2852 mg/m$^2$) |
| Gelatin | (1076 mg/m$^2$) |
| Dye 1 | (344 mg/m$^2$) |
| AgBrI (6.4% I) (0.9μ) | (883 mg/m$^2$) |
| Sensitizing Dye SD-2 | (192 mg/mole Ag) |
| Sensitizing Dye SD-3 | (66 mg/mole Ag) |
| Magenta Dye-Forming Coupler C-2 | (699 mg/m$^2$) |
| Gelatin | (1399 mg/m$^2$) |
| AgBrI (6.4% I) (0.8μ and 0.5μ) | (825 mg/m$^2$) |
| Sensitizing Dye SD-2 | (244 mg/mole Ag) |
| Sensitizing Dye SD-3 | (84 mg/mole Ag) |
| Magenta Dye-Forming Coupler C-2 | (250 mg/m$^2$) |
| Gelatin | (2110 mg/m$^2$) |
| Gelatin | (1076 mg/m$^2$) |
| AgBrI (6.4% I) (0.9μ) | (63.5 mg/m$^2$) |
| Sensitizing Dye SD-4 | (174 mg/mole Ag) |
| Sensitizing Dye SD-5 | (17 mg/mole Ag) |
| Cyan Dye-Forming Coupler C-3 | (527 mg/m$^2$) |
| Gelatin | (1270 mg/m$^2$) |
| AgBrI (6.4% I) (0.8μ) | (678 mg/m$^2$) |
| Sensitizing Dye SD-4 | (192 mg/mole Ag) |
| Sensitizing Dye SD-5 | (19 mg/mole Ag) |
| Cyan Dye-Forming Coupler C-3 | (222 mg/m$^2$) |
| Gelatin | (1066 mg/m$^2$) |
| AgBrI (6.4% I) (0.5μ) | (844 mg/m$^2$) |
| Sensitizing Dye SD-4 | (262 mg/mole Ag) |
| Sensitizing Dye SD-5 | (26 mg/mole Ag) |
| Cyan Dye-Forming Coupler C-3 | (273 mg/m$^2$) |
| Gelatin | (1152 mg/m$^2$) |
| Support | |

SD-1

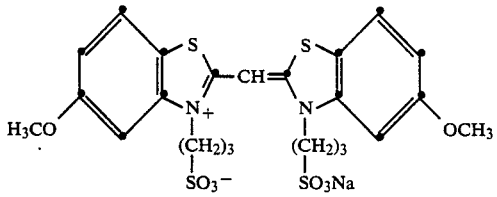

SD-2

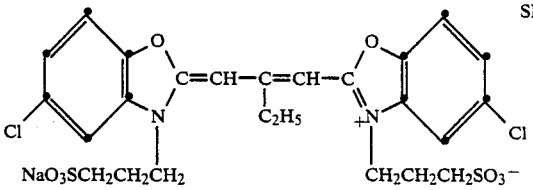

-continued

SD-3

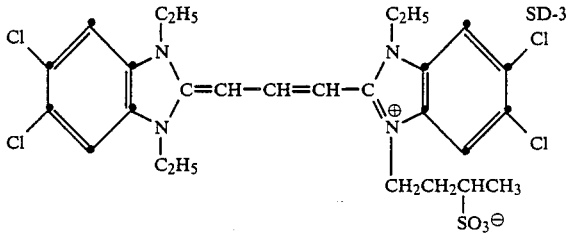

SD-4

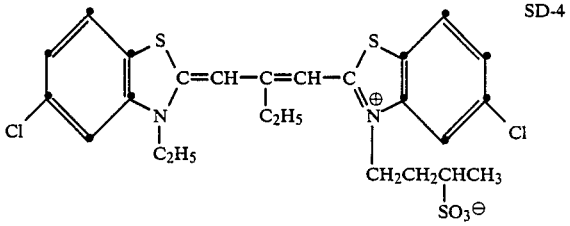

SD-5

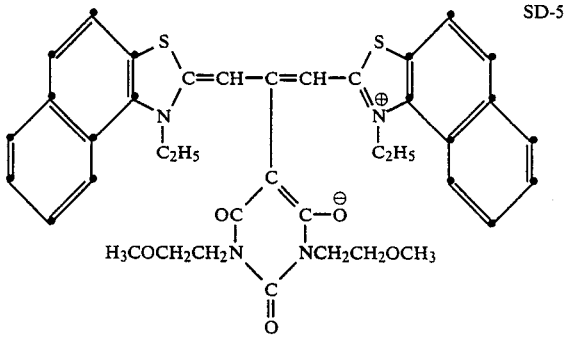

C-1

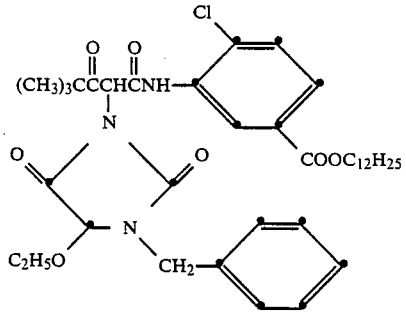

-continued

C-2

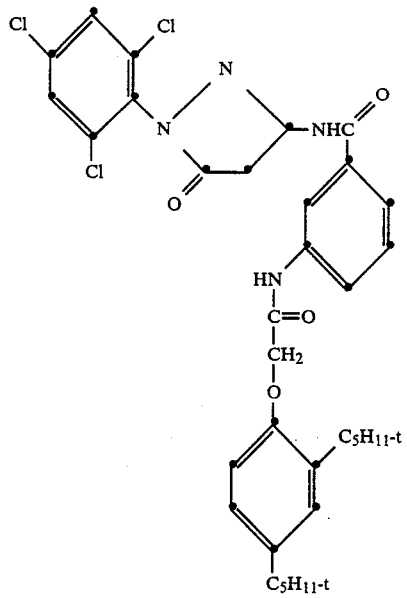

C-3

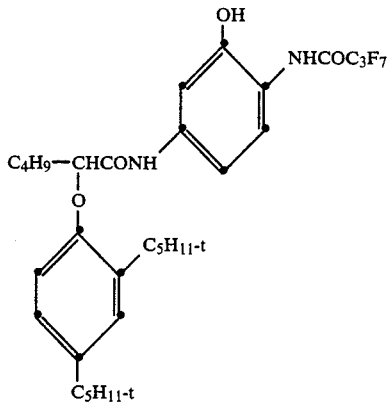

For comparison, identical elements were prepared except that in place of Dye 1 were used Carey Lea silver or a comparison mordanted soluble dye having the formula:

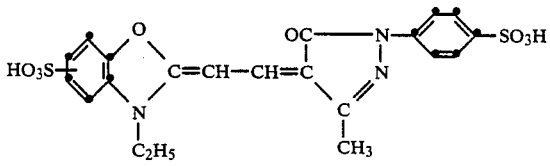

at levels to give equivalent filtering of blue light in their respective elements as that of Dye 1 in the element of the invention. As a control in order to show the effects of the presence of the filter dyes or Carey Lea silver on the element, identical elements were prepared containing neither a yellow filter dye nor Carey Lea silver. The elements were exposed to a test image, processed using Kodak E-6® processing, and the speed and blue layer fog were determined. Kodak E-6® processing is described in *British Journal of Photography Annual*, 1977, pp. 194–97. The results are presented in Table I.

TABLE I

| Filter Dye | Change in Relative Red Speed at Optical Density of 1.0 Compared to Control Red Speed | Change in Relative Green Speed at Optical Density of 1.0 Compared to Control Green Speed | Change in Relative Blue Speed at Optical Density of 1.0 Compared to Control Blue Speed | Change in Fog Compared to Control Fog |
|---|---|---|---|---|
| 1 | −18 | −15 | −38 | −0.01 |
| Comparison Dye | −13 | −33 | −72 | −0.06 |
| Carey Lea Silver | −20 | −47 | −47 | +0.45 |

As shown in Table I, the use of a dye of formula (I) as a yellow filter dye in a photographic element caused smaller losses in green and blue speeds than either the comparison dye or Carey Lea silver while exhibiting similar performance as the comparisons with respect to red speed. Also, the dye of formula (I) contributed no additional fog compared to significant fog from Carey Lea silver.

Examples 2–11 - Spectral Absorption and Bleachability

Dyes according to formula (I) were coated on supports as dispersions in gelatin using high-boiling water-insoluble solvents such as tri-cresyl phosphates and/or N,N-diethyl-dodecanamide, and the spectral absorbance was recorded. The elements were then subjected to a 5-minute distilled water wash and the spectrum was remeasured to evaluate dye wandering characteristics at low pH. The elements were also processed for 6 minutes in each of the two Kodak E-6® developers at 38° C., followed by 1 minute in a 1% $CH_2O$ solution, after which spectral absorbance was recorded again. The results are reported in Table II.

TABLE II

| Dye | Level (g/m²) | λ-max (nm) | OD at λ-max: Before Wash or Processing | OD at λ-max: After Water Wash | OD at λ-max: After Processing (400–700 nm) |
|---|---|---|---|---|---|
| 1 | 0.13 | 422 | 0.98 | 0.99 | 0.01 |
| 2 | 0.14 | 416 | 0.96 | * | 0.01 |
| 3 | 0.14 | 483 | 1.21 | 1.14 | 0.01 |
| 5 | 0.14 | 444 | 0.97 | 0.96 | 0.01 |
| 6 | 0.12 | 420 | 0.67 | 0.66 | 0.01 |
| 7 | 0.14 | 422 | 0.70 | 0.72 | 0.01 |
| 9 | 0.19 | 420 | 1.17 | 1.17 | 0.02 |
| 10 | 0.19 | 419 | 0.95 | * | 0.01 |
| 11 | 0.14 | 417 | 0.68 | 0.65 | 0.01 |
| 12 | 0.16 | 418 | 0.62 | * | 0.01 |

*Dyes 2, 10, and 12 exhibit little or no density loss during water wash, but optical densities were not recorded.

The results in Table II indicate that the dyes according to the invention are effective as filter dyes in the gelatin layers utilized in photographic elements, and are removed and/or decolorized ion during photographic processing.

This invention has been described in detail with particular reference to preferred embodiments thereof. It should be understood, however, that variations and modifications can be made within the spirit and scope of the invention.

What is claimed is:

1. A photographic element comprising a support having thereon a radiation sensitive silver halide emulsion layer and a layer, which is the same as or different from said silver halide layer, comprising a hydrophilic vehicle and a filter dye of the formula:

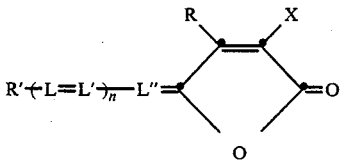

wherein

R is substituted or unsubstituted alkyl or aryl,

X is an electron withdrawing group,

R′ is substituted or unsubstituted aryl or a substituted or unsubstituted aromatic heterocyclic nucleus, L, L′, and L″ are each independently a substituted or unsubstituted methine group, and n is 0 or a positive integer of from 1 to 6.

2. A photographic element according to claim 1 wherein X is selected from the group consisting of cyano, substituted or unsubstituted carboxylate, substituted or unsubstituted aryl, and —CO—R″ wherein R″ is substituted or unsubstituted amino.

3. A photographic element according to claim 1 wherein R′ is selected from the group consisting of phenyl, furan, thiophene, pyridine, pyrrole, and imidazole.

4. A photographic element according to claim 1 wherein R or R′ comprises a substituent that is a solubilizing group.

5. A Photographic element according to claim 4 wherein said solubilizing group comprises an ionizable proton.

6. A photographic element according to claim 5 wherein the dye is in the form of a solid particle dispersion.

7. A photographic element according to claim 1 wherein n is 0.

8. A photographic element according to claim 7 wherein R′ is or is substituted with an electron donor selected from the group consisting of substituted or unsubstituted: furan, thiophene, and pyrrole.

9. A photographic element according to claim 8 wherein R′ is or is substituted with a substituted or unsubstituted furan nucleus.

10. A photographic element according to claim 7 wherein X is cyano.

11. A photographic element according to claim 8 wherein X is cyano.

12. A photographic element according to claim 9 wherein X is cyano.

13. A photographic element according to any of claims 7–12 wherein R or R′ comprises a substituent that is a solubilizing group.

14. A photographic element according to claim 13 wherein said solubilizing group comprises an ionizable proton.

15. A photographic element according to claim 14 wherein the dye is in the form of a solid particle dispersion.

16. A photographic element according to claim 1 wherein the dye has the formula:

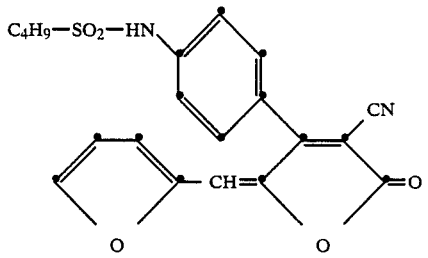

17. A photographic element according to claim 16 wherein the dye is in the form of a solid particle dispersion.

18. A photographic element according to any of claims 7–12 or 16–17 wherein the element comprises a support having thereon, in order, at least one red-sensitive silver halide layer, at least one green-sensitive silver halide layer, said filter dye layer, and at least one blue-sensitive silver halide layer.

* * * * *